US011001479B1

(12) United States Patent
Tyni et al.

(10) Patent No.: US 11,001,479 B1
(45) Date of Patent: May 11, 2021

(54) MONITORING ARRANGEMENT AND METHOD FOR A PEOPLE CONVEYOR

(71) Applicant: KONE Corporation, Helsinki (FI)

(72) Inventors: Tapio Tyni, Helsinki (FI); Pekka Perälä, Helsinki (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 17/020,134

(22) Filed: Sep. 14, 2020

(30) Foreign Application Priority Data

Oct. 23, 2019 (EP) ..... 19204785

(51) Int. Cl.

| | |
|---|---|
| ***B66B 25/00*** | (2006.01) |
| ***B66B 21/04*** | (2006.01) |
| ***B66B 27/00*** | (2006.01) |
| ***B66B 23/24*** | (2006.01) |
| ***B66B 21/10*** | (2006.01) |

(52) U.S. Cl.
CPC ..... *B66B 25/006* (2013.01); *B66B 21/04* (2013.01); *B66B 21/10* (2013.01); *B66B 23/24* (2013.01); *B66B 25/003* (2013.01); *B66B 27/00* (2013.01)

(58) Field of Classification Search
CPC ..... B66B 25/00; B66B 25/006; B66B 21/04; B66B 21/10; B66B 23/24; B66B 25/003; B66B 27/00
USPC ..... 198/322, 323
See application file for complete search history.

(56) References Cited

U.S. PATENT DOCUMENTS

| | | | | |
|---|---|---|---|---|
| 6,015,038 A * | 1/2000 | Stoxen | B66B 23/24 | 198/322 |
| 6,112,166 A * | 8/2000 | Joosten | B66B 27/00 | 198/323 |
| 8,973,731 B2 * | 3/2015 | Ma | B66B 25/003 | 198/323 |
| 2003/0000801 A1 * | 1/2003 | Spannhake | B66B 25/00 | 198/322 |

(Continued)

FOREIGN PATENT DOCUMENTS

| | | |
|---|---|---|
| CN | 102556824 B | 10/2013 |
| JP | 2007-153536 A | 6/2007 |

(Continued)

OTHER PUBLICATIONS

European Search Report issued in EP 19 20 4785, dated Apr. 17, 2020.

*Primary Examiner* — James R Bidwell
(74) *Attorney, Agent, or Firm* — Birch, Stewart, Kolasch & Birch LLP

(57) ABSTRACT

A conveyor arrangement, a conveyor system and a method for determining a load estimate in a people conveyor arrangement, such as an escalator arrangement or horizontal or inclined autowalk arrangement include using a power model of the people conveyor arrangement, which power model includes e.g. motor model components and/or people conveyor model components, having at least a friction monitoring mode, and determining in the friction monitoring mode a friction estimate of the conveyor arrangement based at least in part on the measured or determined motor power, the power model of the people conveyor arrangement, and a speed of the step or pallet chain and/or a speed of the handrail.

21 Claims, 8 Drawing Sheets

(56) References Cited

U.S. PATENT DOCUMENTS

| | | | | |
|---|---|---|---|---|
| 2010/0025185 | A1* | 2/2010 | Winkelhake | B66B 23/04 198/322 |
| 2016/0152447 | A1* | 6/2016 | Xu | B66B 25/003 700/230 |
| 2019/0084807 | A1* | 3/2019 | Nelson | B66B 27/00 |
| 2019/0112161 | A1* | 4/2019 | Park | B66B 23/04 |
| 2020/0385239 | A1* | 12/2020 | Ye | B66B 29/005 |

FOREIGN PATENT DOCUMENTS

| | | | |
|---|---|---|---|
| WO | WO 2009/063125 | A1 | 5/2009 |
| WO | WO 2013/113862 | A1 | 8/2013 |

* cited by examiner

MONITORING ARRANGEMENT AND METHOD FOR A PEOPLE CONVEYOR

TECHNICAL FIELD

The invention relates to the technical field of people conveyors such as escalators and horizontal and inclined autowalk. More particularly, the invention concerns a solution for monitoring an operation of a people conveyor system.

BACKGROUND

People conveyor systems, such as escalator systems and moving walk systems are used in many environments. In order to ensuring that the system works as designed in different circumstances and conditions it's important to monitor the people conveyor system and its components. It's also advantageous to obtain different kind of information relating to the usage of the conveyor device, e.g. how many passengers are using the conveyor device.

In the past the condition monitoring of the escalator and moving walk systems has been mainly the responsibility of the installation or service personnel who have determined whether the condition of the escalator, relating e.g. to friction, is acceptable or not. This kind of solution creates problems because condition monitoring is based on the professional know-how of the service personnel and thus the determined condition can be based on the opinion of an individual service person. Continuous condition monitoring is also not possible because it requires presence of service personnel.

In the prior art people monitoring in escalators and autowalks has been implemented by photodetectors which are arranged on the entry area of an escalator or autowalk so that they are able to recognize passengers entering the escalator or autowalk.

The problem with these prior art passenger monitoring solutions based on photodetectors is that they are not able to accurately determine the number of passenger entering the escalator or autowalk especially in crowded situations, e.g. when people are standing next to each other or when people are walking at the same time through the gate of the photodetector.

There are also some camera-based passenger monitoring solutions which provide more accuracy in monitoring passenger load, especially in the above described crowded situations. But these kind of solutions are expensive and they are external systems which require extra maintenance compared to more traditional systems based on photodetectors.

SUMMARY

The following presents a simplified summary in order to provide basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

An objective of the invention is to present a method and conveyor arrangement for monitoring an operation of the conveyor system.

The objectives of the invention are reached by a conveyor system as defined by the respective independent claims.

According to a first aspect, a method for determining a load estimate in a people conveyor arrangement, such as an escalator arrangement or horizontal or inclined autowalk arrangement is provided. The method comprises using a power model of the people conveyor arrangement, which power model comprises e.g. motor model components and/or people conveyor model components. The method further comprises having at least a friction monitoring mode and determining in the friction monitoring mode a friction estimate of the conveyor arrangement based at least in part on the measured or determined motor power, and the power model of the people conveyor arrangement, and speed of the step or pallet chain and/or speed of the handrail.

According to a second aspect, a people conveyor arrangement, such as an escalator arrangement or horizontal or inclined autowalk arrangement is provided. The people conveyor arrangement comprises at least a motor, means for determining or measuring motor power, a step or pallet chain, a handrail, and means for determining speed of the step or pallet chain and/or means for determining speed of the handrail. The arrangement further comprises a power model of the people conveyor arrangement, which power model comprises e.g. motor model components and/or people conveyor model components. The arrangement further comprises at least a friction monitoring mode, and in the friction monitoring mode the arrangement is configured to the determine a friction estimate of the arrangement based at least in part on the measured or determined motor power, the power model of the people conveyor arrangement, and speed of the step or pallet chain and/or speed of the handrail.

According to a third aspect a people conveyor system, such as an escalator system or inclined or horizontal autowalk system, is provided which comprises at least the arrangement according to the invention.

In one embodiment of the invention the determined and/or measured motor power is motor active power.

In one embodiment of the invention the arrangement comprises means to determine presence of passengers and the arrangement uses the friction monitoring mode essentially always when no passengers are detected, e.g. after no passengers are detected during a certain duration, such as one or multiple people conveyor cycles, and when the people conveyor is not stopped, e.g. it is running at nominal speed. In one embodiment of the invention the arrangement comprises means to determine presence of passengers and the arrangement uses the friction monitoring mode at certain times when no passengers are detected, e.g. at certain times after no passengers are detected during a certain duration, such as one or multiple people conveyor cycles, and when predefined conditions are fulfilled, the predefined conditions relating to e.g. a predetermined time window for determining friction estimate and/or the target number of friction estimate determinations in a predefined duration, e.g. during a day, and when the people conveyor is not stopped, e.g. it is running at nominal speed.

In the embodiment of the invention the friction monitoring mode doesn't have to be activated always when it would be possible, but that mode can be activated when it's desired and when the conveyor arrangement is running without passengers, e.g. at nominal speed.

In one embodiment of the invention the solution of the invention further comprises a passenger load monitoring mode, wherein in the passenger load monitoring mode the arrangement determines the passenger load estimate based at least in part on measured or determined motor power, the friction estimate, the power model of the people conveyor arrangement, and speed of the step or pallet chain and/or speed of the handrail, wherein the friction estimate is the friction estimate determined in the friction monitoring mode or based on an initial value if a friction estimate is not yet determined in the friction monitoring mode.

In one embodiment of the invention the arrangement comprises means to determine presence of passengers and the arrangement uses the passenger load monitoring mode essentially always when passengers are determined to be present and when the people conveyor is not stopped, e.g. it is running at nominal speed. In one embodiment of the invention the arrangement uses the passenger load monitoring mode at certain times when passengers are determined to be present and/or when predefined conditions are fulfilled, the predefined conditions relating to e.g. deactivated state of the friction monitoring mode, a predetermined time window for determining passenger load estimate and/or the target number of passenger load estimate determinations in a predefined duration, e.g. during a day, and when the people conveyor is not stopped, e.g. it is running at nominal speed. In one embodiment of the invention the conveyor arrangement uses the passenger load monitoring mode when the state of the people conveyor arrangement is changed from stopped or stand-by-speed to nominal speed.

In the one embodiment of the invention the passenger load monitoring mode doesn't have to be activated always when it would be possible, but it can be activated when it's needed or desired and when the people conveyor is not stopped, e.g. it is running at nominal speed. The passenger load monitoring mode can be activated also when there are no passengers. In one embodiment of the invention the friction monitoring mode and passenger load monitoring mode don't have to be activated always when it would be possible to use these modes but there can be times when none of the modes is activated. These modes can be activated when they are needed. In one embodiment of the invention the conveyor device may use the passenger load monitoring mode always when the friction monitoring mode is not active. In one embodiment of the invention one mode is always activated, in which case when the passenger load monitoring mode is not used, the arrangement uses friction monitoring mode and when the friction monitoring mode is not used, the arrangement uses the passenger load monitoring mode. In one embodiment of the invention no mode is active when the people conveyor is stopped and/or it's not running at nominal speed.

In one embodiment of the invention the arrangement uses as parameters of the power model of the people conveyor at least one of the following: motor losses, bearing losses, friction losses, inertia mass, speed of the step or pallet chain, speed of the handrail.

In one embodiment of the invention at least some of the parameter values of the motor model components and people conveyor model components of the power model are defined during testing of the people conveyor arrangement, by calculation, based on simulation and/or based on the model and type of the components of the system.

In one embodiment of the invention the arrangement defines estimated motor power from the estimated load (e.g. passenger load and/or friction force estimate, later called friction estimate) by using the power model.

In one embodiment of the invention the arrangement determines the friction estimate by using the passenger load estimate defined as essentially zero as a parameter value for the power model, and by adapting friction estimate in the power model so that the difference between the measured power and estimated power based on power model is minimized, e.g. the difference between the measured power and estimated power is within a predefined limit.

In one embodiment of the invention the arrangement determines the passenger load estimate by using the friction estimate determined in the friction monitoring mode or initial value of the friction estimate as a parameter value for the power model, and by adapting the passenger load estimate in the power module so that the difference between the measured power and estimated power based on power model is minimized, e.g. the difference between the measured power and estimated power is within a predefined limit.

In one embodiment of the invention the arrangement measures the motor power at a certain time instance or during a certain time frame, e.g. average motor power during a predefined time frame. In one embodiment of the invention the means for measuring motor power are internal measuring means of the electrical converter or inverter unit or an external measuring apparatus.

In one embodiment of the invention the arrangement sends to a server, such as a server of a cloud service, via a network, such as internet, at least one of the following: the determined friction value, determined passenger load value, measured or determined motor power, speed of the step or pallet chain, speed of the handrail, the power model of the people conveyor, parameters and/or parameter values relating to the power model of the people conveyor.

With the solution of the invention condition monitoring information and person load monitoring information can be provided to the users of the system, e.g. to the maintenance personnel. The information determined by the solution of the invention can be utilized in many ways e.g. to see how much the conveyor device is used, to follow the condition of the conveyor device, and to providing insight information about electro-mechanical properties of the conveyor system. Also, the collected information can be stored and saved to a database and further analyzed. One benefit of the solution of the present invention is that it can be integrated to the system and no new sensors are not necessarily needed for condition and passenger load monitoring.

The solution of the invention can be used for example in factory testing after final assembly so that all parameters detected by the solution using power model are within specifications (e.g. bearing & handrail frictions, motor efficiency etc.). This way the quality of frictions, e.g. variance, tight spots etc. and the operation of handrail adjustment can be checked to ensure that the conveyor sent to customer site fulfills the specifications.

The solution of the invention can also be used in installation, handover or maintenance phase in the corresponding way to ensure that the conveyor handed over to customer or after the maintenance fulfills the specifications. The solution can also be used at on site in problem finding to get additional information for fault finding.

The expression "a number of" refers herein to any positive integer starting from one, e.g. to one, two, or three.

The expression "a plurality of" refers herein to any positive integer starting from two, e.g. to two, three, or four.

Various exemplifying and non-limiting embodiments of the invention both as to constructions and to methods of operation, together with additional objects and advantages thereof, will be best understood from the following description of specific exemplifying and non-limiting embodiments when read in connection with the accompanying drawings.

The verbs "to comprise" and "to include" are used in this document as open limitations that neither exclude nor require the existence of unrecited features. The features recited in dependent claims are mutually freely combinable unless otherwise explicitly stated. Furthermore, it is to be understood that the use of "a" or "an", i.e. a singular form, throughout this document does not exclude a plurality.

BRIEF DESCRIPTION OF FIGURES

The embodiments of the invention are illustrated by way of example, and not by way of limitation, in the figures of the accompanying drawings.

DESCRIPTION OF THE EXEMPLIFYING EMBODIMENTS

The specific examples provided in the description given below should not be construed as limiting the scope and/or the applicability of the appended claims. Lists and groups of examples provided in the description given below are not exhaustive unless otherwise explicitly stated.

In the solution of the invention a power model of the people conveyor arrangement is used, which power model comprises e.g. motor model components and/or people conveyor model components. The solution of the invention comprises at least a friction monitoring mode and a friction estimate of the conveyor arrangement is determined in this mode based at least in part on the measured or determined motor power, the power model of the people conveyor arrangement, and speed of the step or pallet chain and/or speed of the handrail.

Figure 1:
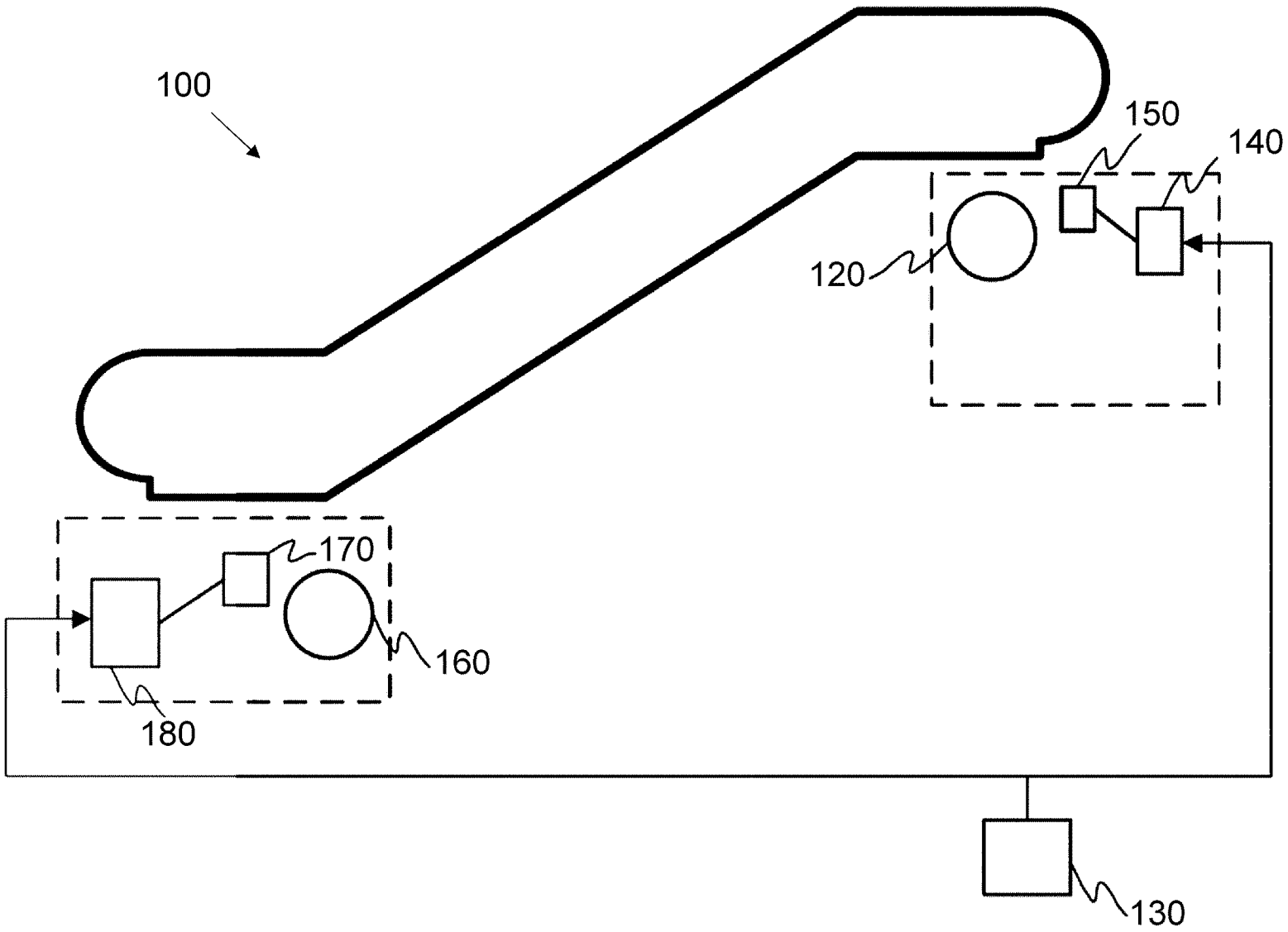
FIG. 1 presents schematically an embodiment according to the present invention in which the conveyor system is an escalator system.

FIG. 1 schematically illustrates an embodiment according to the present invention in which the conveyor system is an escalator system 100 in which the solution of the invention is applied to. The escalator system may comprise a step-chain coupled to a motor 120 via a transmission comprising at least a chain or belt or similar. The motor 120 may generate a rotational force via the transmission causing the step-chain to move in an intended travelling direction. A brake may be arranged to the conveyor system so that when de-energized it is configured to meet the rotating axis of the transmission and, in that manner, to brake movement of the step chain or keep the step chain standstill when the escalator system is idle. When energized, the brake opens, allowing movement of step-chain. The transmission may comprise, in the context of escalator system, a gearbox with the mentioned entities. Furthermore, the escalator system may comprise a conveyor control unit 130 which may e.g. be configured to control the movement of step-chain through a control of a power supply to the motor 120 and to the escalator brake. Thus, the conveyor control unit 130 may be configured to execute tasks of an electrical converter or inverter unit and an escalator control board.

The monitoring arrangement according to an example embodiment as illustrated in FIG. 1 may comprise means to measure motor power. The arrangement can also comprise means for measuring speed of the step or pallet chain and/or means for measuring speed of the handrail.

In one embodiment of the invention speed of the step or pallet chain can be measured, e.g. with means to measuring speed of the step or pallet chain. In one embodiment of the invention the system knows the desired and/or the selected speed of the step or pallet chain and this information can be used as speed of the step or pallet chain. In this case speed of the step or pallet chain doesn't have to be measured. In one embodiment of the invention speed of the handrail can be measured, e.g. with means to measuring speed of the handrail. In one embodiment of the invention the system knows the desired and/or the selected speed of the handrail and this information can be used as speed of the handrail. In this case speed of the handrail doesn't have to be measured. In one embodiment of the invention motor power can be determined internally, e.g. by the electrical converter or inverter unit. In one embodiment of the invention motor power can be determined or measured with an external apparatus, such as an energy meter or power meter (e.g. which can measure energy or power going through the meter, such as active power) and/or external measuring arrangement.

In one embodiment of the invention the conveyor system can comprise a processing unit 140. The processing unit 140 may be used to obtain measurement data from e.g. means to measure power of the motor and/or means for measuring speed of the step or pallet chain, and/or means for measuring speed of the handrail.

Sensors, such as means to measure power of the motor and/or means for measuring speed of the step or pallet chain and/or means for measuring speed of the handrail, may be arranged in the connection with the motor and/or transmission. The sensors may be individually wired to the processing unit, or the communication may be performed in a wireless manner. For each sensor the wiring may provide supply voltage from the processing unit to the sensor as well as signal connection from the sensor to the processing unit 140. Furthermore, the processing unit 140 may be communicatively coupled to the conveyor control unit 130 with an applicable communication channel, such as with a serial data bus or a parallel data bus or a combination of them or the functionality of the processing unit 140 can be integrated to the conveyor control unit 130.

In some embodiments a second motor 160 with a second transmission may be provided, for example, at the opposite end of the step-chain. Then a second processing unit 180 as well as further sensor(s) may be mounted to the in connection with the second motor. The second processing unit 180 may be connected to conveyor control unit 130 with the serial data bus, for example, for transferring the processed measurement data to the conveyor control unit 130 for further analysis.

Alternatively the monitoring arrangement may be implemented so that the second processing unit 180 transfers the data, in a raw form or in a processed form, to the first processing unit 140, which is configured to process all the measurement data and transfer it, through a communication, to the conveyor control unit 130. In other words, the processing unit 140, 180 may be implemented in a distributed manner in the machinery sides of the escalator system and in some implementation they communicate directly with the conveyor control unit 130 whereas in another implementation one of the processing units 140, 180 is selected as a master device for gathering the data from one or more other processing units 140, 180 and to communicate the obtained data, in a predetermined format, to the conveyor control unit 130. In one embodiment of the invention at least one processing unit may be arranged to an external apparatus, server and/or service.

In the above described implementations in the context of escalator system the conveyor control unit 130 may also be arranged to perform a task of supplying power to the motor 120, or to the both motors 120 and 160, i.e. performing tasks of so-called electrical converter or inverter unit.

In case the conveyor system is the moving walk system the above given considerations with respect to the present invention at least in the escalator environment are directly applicable.

In one embodiment of the invention passengers entering or present at the conveyor system can be detected by using means to detect presence of a person. These means can be arranged, e.g. so that they can detect arrival or presence of a person at the entry area of the escalator or autowalk. In one embodiment of the invention means for detecting presence 150, 170 can be e.g. a photodetector-based sensor or sensor at the entry area which can detect weight of the person entering the conveyor system such as an escalator or moving walk. Usually people don't walk backward when they are on the escalator or moving walk. Therefore in one embodiment of the invention it can be assumed that the conveyor system is empty if no new passengers are detected at the entry area during one cycle of the conveyor arrangement.

Figure 2:
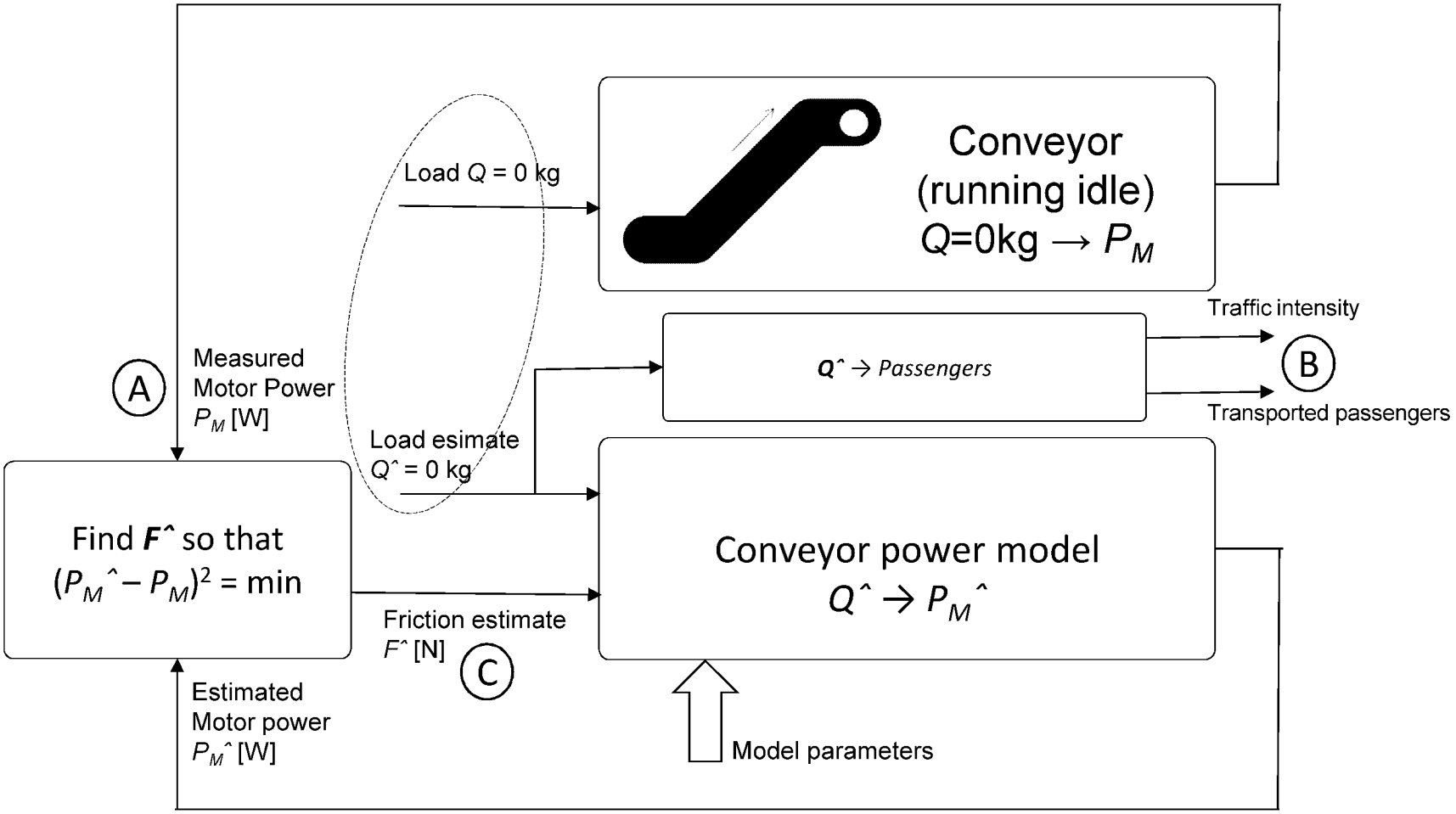
FIG. 2 presents as a diagram one example implementation embodiment of the friction estimate monitoring mode.

FIG. 2 presents as an example one implementation embodiment of the friction estimate monitoring mode. In the friction monitoring mode the conveyor system should be running idle with no passengers. The arrangement is configured to measure motor power $P_M$ in these circumstances. In this mode an estimated motor power $P_M\hat{}$ can be determined with the power model using passenger load estimate $Q\hat{}$ as zero (as there are no passengers) and friction estimate $F\hat{}$ (which is updated in this case) for parameter values of the power model. Next the motor power estimate $P_M\hat{}$ determined via the power model is compared to the measured or determined power $P_M$. Friction estimate $F\hat{}$ is updated in the power model so that the difference of the estimated motor power $P_M\hat{}$ determined via the power model to the measured or determined power $P_M$ is minimized towards zero, e.g. as long as the difference is within certain predefined range or below certain threshold value. Other parameter values can be kept unchanged during this stage of the process. The friction estimate $F\hat{}$ used as a parameter value in the model when the difference is minimized, within certain predefined range or below certain threshold value, is the determined friction estimate $F\hat{}$ which can be stored and/or sent to the required systems or units. Other model parameter values of the power model can be kept unchanged during this process and they can have been predefined e.g. during testing of the system, based on the model, type and specification of a certain component of the system, by calculation and/or based on simulation.

In one embodiment of the invention the solution of the invention further comprises a passenger load monitoring mode, wherein in the passenger load monitoring mode a passenger load estimate is determined based at least in part on measured or determined motor power, the friction estimate, the power model of the people conveyor arrangement, and speed of the step or pallet chain and/or speed of the handrail. The friction estimate determined in the friction monitoring mode or based on an initial value if a friction estimate is not yet determined in the friction monitoring mode.

The friction estimate of the system changes over time. Therefore, for example to be able to accurately estimate the passenger load, it's advantageous to use also an up-to date estimate of the friction level. Therefore, the system can collect and determine friction estimates essentially regularly.

The friction level can change during the day and/or based on the surrounding temperature. In one embodiment of the invention, determining the friction estimate can be done, e.g. at certain time of the day when no presence of people is determined and/or certain times in certain time frame, e.g. day, week, month. This way the system can e.g. determine and store friction values which can be used in monitoring the condition of the conveyor system. Friction estimates determined at different conditions and e.g. different times of the day can be used differently and e.g. so that friction levels in determined shortly after switching on the conveyor system are used in condition monitoring but not in determining the passenger load estimate in the passenger load monitoring mode, and/or friction levels in determined when the conveyor system has been running a certain period of time, i.e. is in steady state, can be used in condition monitoring and in determining the passenger load estimate in passenger load monitoring mode. Friction levels determined shortly after when the conveyor device has been switched may not be as reliable or accurate for determining passenger load when comparing to the frictions levels determined in the steady state of the system.

Initial value for the friction estimate can be defined based on testing carried out when correct parameter values are determined for the power model of the conveyor arrangement.

By the solution of the invention the determined friction estimate can to adapt to the friction levels changing over time.

The determined friction estimate can be stored and e.g. sent to a server or service, such as cloud service, for further analysis, like trends etc.

Figure 3:
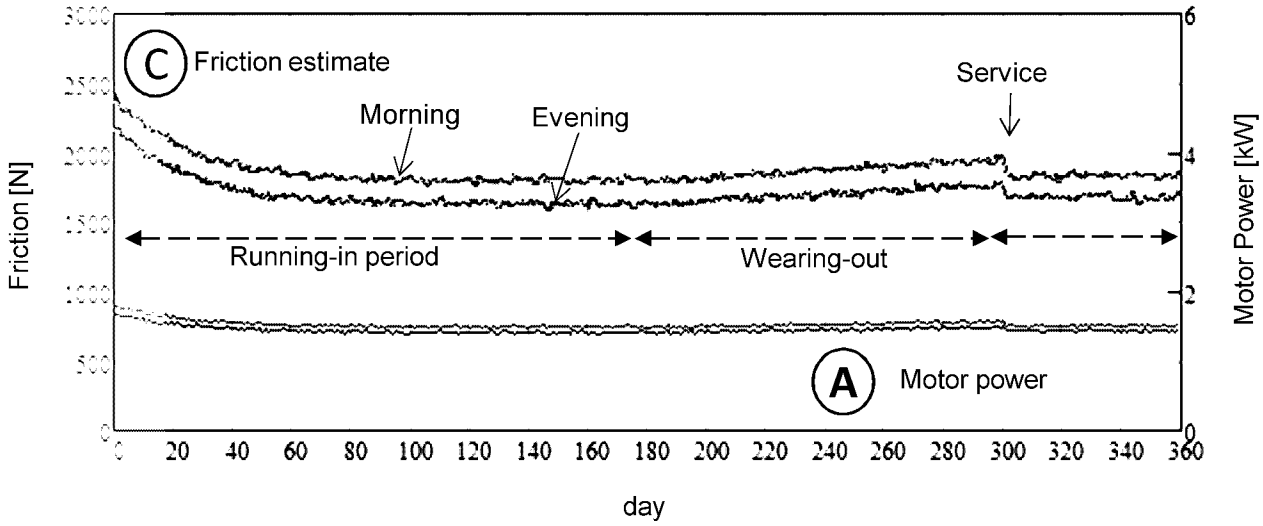
FIG. 3 presents as an example what kind of data can be measured and/or determined in the friction monitoring mode.

FIG. 3 presents as an example what kind of data can be measured and/or determined in the friction monitoring mode. A in FIG. 3 presents measured motor power and C presents the determined friction estimate. In the figure there are two separate graphs, one for the friction determined in the morning after the conveyor device is switched on and one for the afternoon representing a situation where the conveyor system is warm and has been running certain amount of time so that it is in steady-state. FIG. 3 also presents how the friction estimate evolves during time. In the beginning, i.e. after the conveyor device is taken into the use, there is running in period in which the friction of the system is reduced. The friction of the system starts to increase again when the components of the system begin to wear out causing increased friction. Then after service the friction level should be once again on the designed level. With the present invention this kind of information which describes the condition of the conveyor device can be collected and provided to the users and e.g. maintenance personnel.

Figure 4:
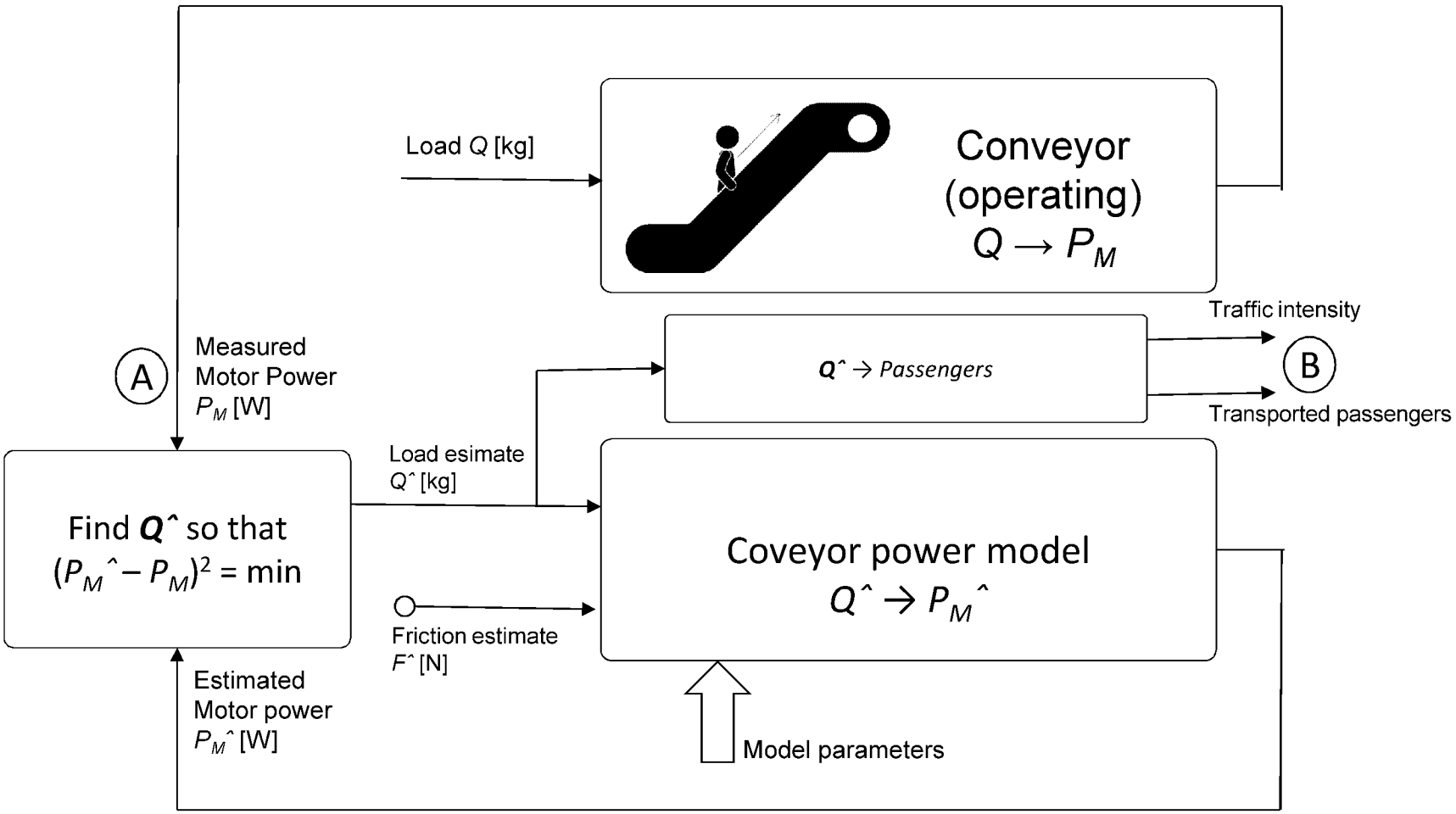
FIG. 4 presents as a diagram one example implementation embodiment of the passenger load monitoring mode.

FIG. 4 presents as an example one implementation embodiment of the passenger load monitoring mode. In the passenger load monitoring mode there can be passengers present using conveyor system. The arrangement is configured to measure motor power $P_M$. In this mode an estimated motor power $P_M\hat{}$ can be determined with the power model, using the determined friction estimate F^ (determined in the friction estimate monitoring mode or an initial value if no friction estimate determination is not yet carried out) and a passenger load estimate Q^ (which is updated in this case) as a parameter values of the power model. Next the motor power estimate $P_M\hat{}$ determined via the power model is compared to the measured or determined power $P_M$. The passenger load Parameter Q^ is updated in the power model so that the difference of the estimated motor power $P_M\hat{}$ determined via the power model to the measured or determined power $P_M$ is minimized towards zero, e.g. as long as the difference is within certain predefined range or below certain threshold value. Other parameter values can be kept unchanged during this stage of the process. The passenger load Q^ used as a parameter value in the model when the difference is minimized, within certain predefined range or below certain threshold value, is the determined passenger load Estimate ^ which can be stored and/or sent to the required systems or units. The passenger load Estimate ^ can be or it can be used to determine e.g. traffic intensity and/or number of transported passengers. Other model parameter values of the power model can be kept unchanged during this process and they can have been predefined e.g. during testing of the system and/or based on the model, type and specification of a certain part of the system.

The determined passenger load can be stored and e.g. sent to a server or service, such as cloud service, for further analysis, like trends etc.

Figure 5A:
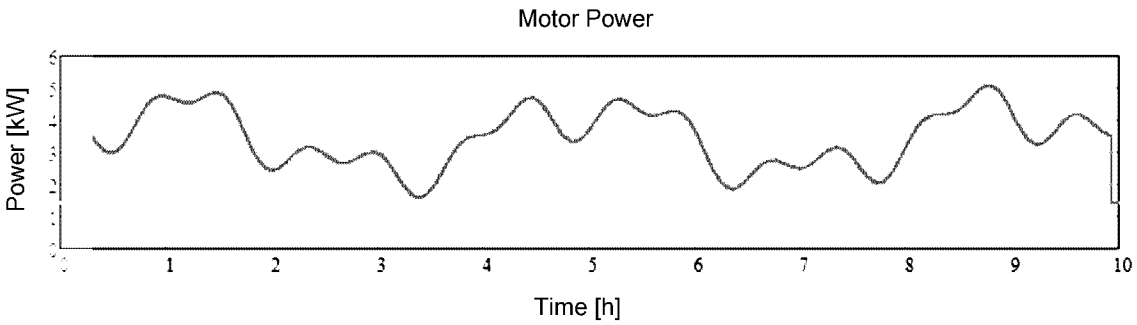
FIGS. 5A and 5B present as an example what kind of data can be measured and/or determined in the passenger load monitoring mode.
Figure 5B:
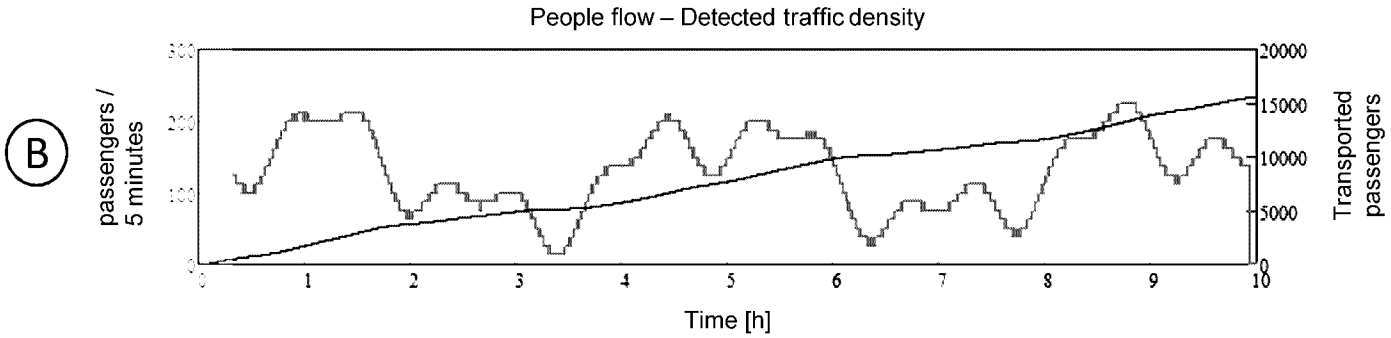

FIGS. 5A and 5B present as an example what kind of data can be measured and/or determined in the passenger load monitoring mode. In the FIG. 5A measured motor power during the operation period of the conveyor system is presented. FIG. 5B presents the passenger load level determined using the solution of the invention during the same time period. Cumulative number of transported passengers is also shown in FIG. 5B.

Figure 6A:
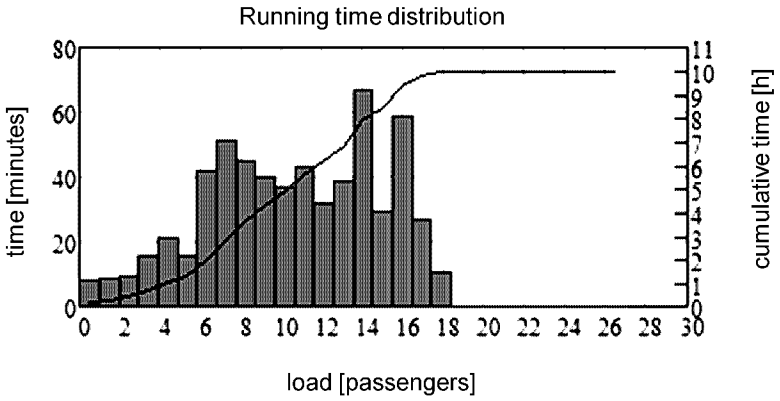
FIGS. 6A-6C present as an example what kind of data can be measured and/or determined in the passenger load monitoring mode.
Figure 6B:
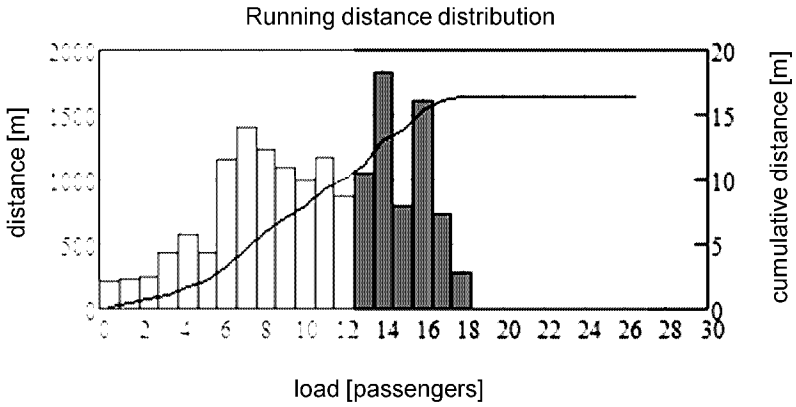
Figure 6C:
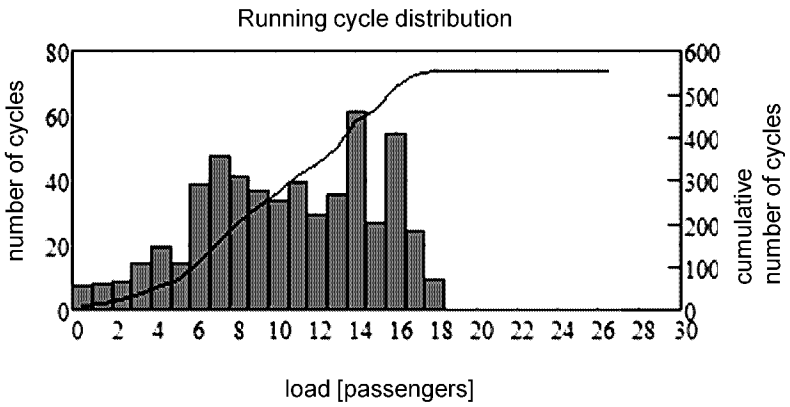

FIGS. 6A-6C present as an example what kind of data can be measured and/or determined in the passenger load monitoring mode.

FIG. 6A presents a running time distribution of the load of passengers during operation of the conveyor device, i.e. information about the durations driven with different passenger loads. Also load versus cumulative time is presented in the FIG. 6A.

FIG. 6B presents a running distance distribution of the load of passengers during operation of the conveyor device, i.e. information about the distance driven with different passenger loads. Also load versus cumulative distance is presented in the FIG. 6B.

FIG. 6C presents a running cycle distribution of the load of passengers during operation of the conveyor device, i.e. information about the number of cycles driven with different passenger loads. Also load versus cumulative number of cycles is presented in the FIG. 6C.

The determination of the friction estimate and/or passenger load estimate with the power model can be done locally, e.g. within a control unit of the system, electrical converter or inverter unit of the system and/or in an external unit arranged in connection to the conveyor apparatus, and/or in an external server or service to which the required information can be sent via a network.

If external apparatus and/or service is used in measuring or determining the motor power and/or the friction estimate and/or passenger load estimate, information determined from the system is sent to the apparatus and/or service or the apparatus/or service fetches the information. Based on this information the friction estimate and/or passenger load estimate can be determined at the apparatus or the external server and/or service.

In one embodiment of the invention some steps can be carried out locally and some steps at the external apparatus, server and/or service. For example, gathering required information and/or measuring or determining motor power and speed of the step or pallet chain and/or speed of the handrail can be done locally and determination of the friction estimate and/or passenger load estimate at the external apparatus and/or server or service.

A power model is used in the solution of the invention to model the operation of electrical and mechanical parts of the conveyor device. The power model comprises a number of parameters describing power flow in the conveyor system and e.g. motor model components and/or people conveyor model components. A power model presented in WO2013113862A1- and WO2009063125A1-publications, which are hereby incorporated by reference, can be used as an example of a power model which can be used in the solution of the invention.

In the power model, power flow in the conveyor system can be described by means of conveyor system parameters. Power is supplied to the conveyor system from a power supply, which can be e.g. a network supply and/or a generator. A motor power supply device receives the power feed from the power supply. The motor, and/or electrical converter or inverter unit can comprise blocks which describe power flow in the motor power supply device and the conveyor motor.

The correct parameter values of the power model, i.e. parameter values representing the real and/or actual conveyor system, can be found out e.g. based on testing for example at the factory or at installation location. The testing can be done to the specific system which is later installed and in this case the parameter values determined during testing are determined specifically for that conveyor system.

The correct parameter values of the power model, i.e. parameter values representing the real and/or actual conveyor system, can be found out in one embodiment of the invention by calculation, based on simulation and/or based on the model and type of the components of the system. If the parameter values (or a part of the parameter values) are determined based on calculation and/or simulation, calculation and/or simulation can be based on friction approximation of different components, the masses of the components and based on that, their inertia, etc.

As stated above, the power model can include a number of parameters describing power flow in the conveyor system. In one example embodiment of a power model, the power model comprises input parameters. A first input parameter can contain data representing e.g. the speed of the step or pallet chain of the conveyor arrangement and/or speed of the handrail. A second input parameter can contain the elevator motor supply power corresponding to the speed data. The data of the input parameters can be read simultaneously and stored as a parameter set during determination of parameter values, e.g. during testing. The read or measuring operation can be repeated at regular intervals during the determination of the parameter values of the conveyor system power model. Input parameters refers to parameters for which the data is determined from the conveyor system e.g. by reading or measuring. The power model can also comprise at least one status parameter, whose value is adapted using at least the updated power model and at least one input parameter.

An input parameter mentioned above may also consist of e.g. measured motor feed power data, which can be measured e.g. from the motor currents and voltages. Similarly, status parameters can refer to parameters that describe the conveyor system but whose values have not been determined from the conveyor system. Status parameters may be lockable, in which case parameter adaptation is only carried out for those parameters which have not been locked. Locked parameters are held constant during adaptation. In an embodiment of the invention, the same power model according to the invention can also be used in several different parameter adaptation processes, wherein an input parameter may function in another adaptation process as a status parameter, and vice versa. In an embodiment of the invention, momentary values are read or measured for input parameters simultaneously, and parameters that have been read simultaneously form successive sets of parameter elements in which the parameters correspond to each other.

The power estimate thus produced with the power model and the read or measured values can be compared to the corresponding power flow value derived from the conveyor motor supply power e.g. at a certain point of the conveyor system. Selected status parameters of the power model can be modified by adapting them using a cost function so that the estimate of power flow at the certain point approaches the power flow value derived from the supply power of the elevator motor. The difference between the estimated power and the power derived from the motor supply power is now determined, and the cost function tends to minimize this difference by adapting the selected non-locked status parameters.

In one example embodiment, determining parameter values of the power model can be implemented in the following way: parameters describing power flow in the conveyor system can be fitted into the power model, at least a first and a second input parameter of the conveyor system can determined, e.g. during one or more test runs, the power model can be updated on the basis of at least one input parameter (e.g. the first input parameter) thus determined and at least one status parameter of the conveyor system can be adapted using the updated power model and at least one input parameter (e.g. the second input parameter). Adaptation of parameters refers to modifying at least one status parameter so that the power model is adjusted with certain optimization criteria.

The examples of the parameters of the power module, which are defined during determination of parameter values, e.g. during testing, by calculation, based on simulation and/or based on the model and type of the components of the system, and used in estimation of friction estimate and/or passenger load during the operation of the device can be e.g. motor losses, bearing losses, friction losses, inertia mass, speed of the step or pallet chain, speed of the handrail.

As stated above, parameters of the power model of the conveyor device used in the solution of the invention can be determined in one embodiment of the invention during one or several test runs and/or simulations. In one embodiment of the invention at least a part of the parameter values can be set or determined by the type of the conveyor system and/or based on the type of parts and components of the conveyor system.

During the test runs the optimization of the power model parameters can be performed by comparison with the measured input parameters, which input parameters are measured during one or more test runs. The model parameters can be challenged as to minimize the difference between at least one of the input parameters and the corresponding measured values.

If the parameter values are determined through testing, the test can be carried out with a conveyor device, such as an escalator or autowalk, without an inverter unit with an external test module with inverter driving the motor, e.g. with external tachometer to measure step or pallet chain speed and/or handrail speed and data acquisition system and analysis software.

If the parameter values are determined through testing, the test can be carried out with a conveyor device, such as an escalator or autowalk, comprising an inverter unit with external tachometer to measure step or pallet chain speed and/or handrail speed and data acquisition system and analysis software.

Figure 7A:
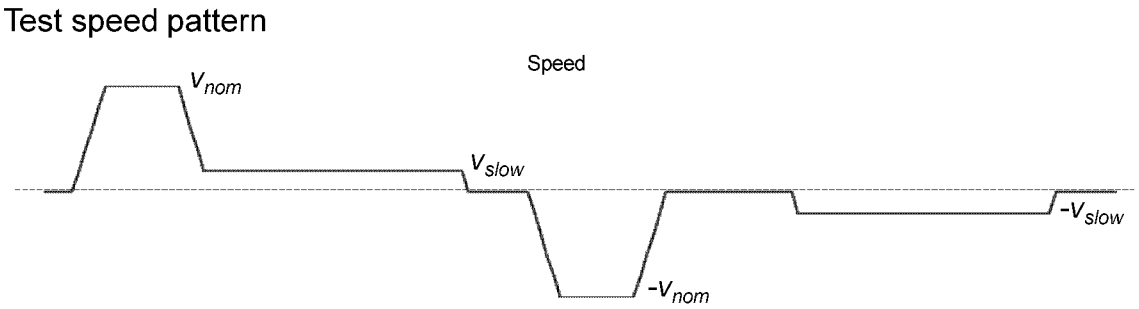
FIG. 7A presents one embodiment of an example test speed pattern which can be used when determining parameters of the power model of the conveyor device.

FIG. 7A presents one embodiment of an example test speed pattern which can be used when determining parameters of the power model of the conveyor device. In the example embodiment a full travel test run can comprise both running directions, e.g. up (+) and down (−) or forward and backward, two speeds, e.g. nominal speed ($v_{nom}$) and slow speed ($v_{slow}$), controlled acceleration and deceleration and with true speed of step or pallet chain and/or handrail.

Figure 7B:
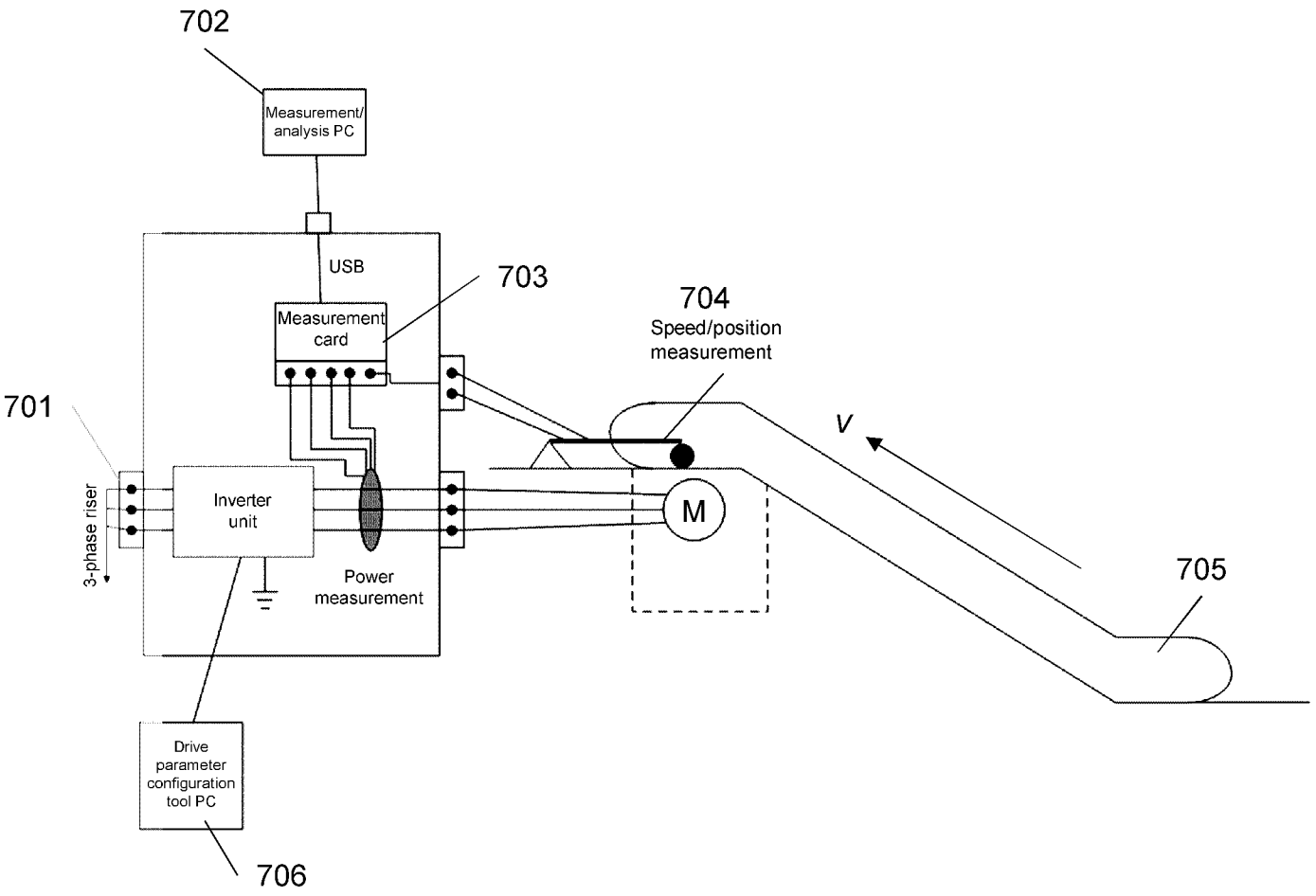
FIG. 7B presents one embodiment of an example test arrangement which can be used when determining parameters of the power model of the conveyor device.

FIG. 7B presents one embodiment of an example test arrangement which can be used when determining parameters of the power model of the conveyor device. In the example arrangement of FIG. 7B power is supplied to the escalator system from a power supply, which in this example is a network supply 701, but which could also be e.g. a generator. A motor power supply device receives power feed from the power supply.

There can be different arrangement for logging the motor and other conveyor system data. In one example embodiment for measuring the motor power for example a computer 702 and/or data acquisition unit, such as a USB-based unit 703, can be used which is configured to measure the currents and voltages. AC/DC-current clamps and isolated differential probes can be used for safe measurements without distortion. The testing arrangement can also comprise means for determining speed and position of the step or pallet chain 704 and/or means for determining speed and position of the handrail. Also an external device 706 such as a computer can be used to set and control the drive parameters of the conveyor system.

During testing power model parameters describing power flow in the conveyor system are fitted into the power model and the model parameters are optimized under use of at least one of the input parameters of the conveyor device. Model parameters can be e.g. optimized by minimizing the error square of at least one of the first and second input parameters with respect to the corresponding model parameter. This way parameter values for the power model are obtained, which can be used to determine friction estimates and passenger load estimates when the conveyor system is in use.

The specific examples provided in the description given above should not be construed as limiting the applicability and/or the interpretation of the appended claims. Lists and groups of examples provided in the description given above are not exhaustive unless otherwise explicitly stated.

What is claimed is:

1. A method for determining a load estimate in a people conveyor arrangement, comprising the steps of:

using a power model of the people conveyor arrangement, the power model comprising motor model components and/or people conveyor model components;

having at least a friction monitoring mode; and determining, in the friction monitoring mode, a friction estimate of the people conveyor arrangement based at least in part on measured or determined motor power, the power model of the people conveyor arrangement, and a speed of a step or pallet chain and/or a speed of a handrail of the people conveyor arrangement.

2. The method according to claim 1, wherein the friction monitoring mode is used in the method:

essentially always when no passengers are detected with means to determine presence of passengers; or at certain times when no passengers are detected with means to determine presence of passengers; and when predefined conditions are fulfilled, the predefined conditions relating to a predetermined time window for determining friction estimate and/or the target number of friction estimate determinations in a predefined duration.

3. The method according to claim 1, further comprising the steps of:

having a passenger load monitoring mode; and determining, in the passenger load monitoring mode, a passenger load estimate based at least in part on measured or determined motor power, a friction estimate, the power model of the people conveyor arrangement, and the speed of the step or pallet chain and/or the speed of the handrail of the people conveyor arrangement, wherein the friction estimate is the friction estimate determined in the friction monitoring mode or based on an initial value if a friction estimate is not yet determined in the friction monitoring mode.

4. The method according to claim 3, wherein the method comprises using the passenger load monitoring mode:

essentially always when passengers are determined to be present with the means to determine presence of passengers; or at certain times when passengers are determined to be present with the means to determine presence of passengers; and/or when predefined conditions are fulfilled, the predefined conditions relating to a deactivated state of the friction monitoring mode, a predetermined time window for determining passenger load estimate and/or the target number of passenger load estimate determinations in a predefined duration; and/or when the state of the people conveyor arrangement is changed from stopped or stand-by-speed to nominal speed.

5. The method according to claim 1, further comprising the step of using at least one of the following as a parameter of the power model of the people conveyor arrangement: motor losses, bearing losses, friction losses, inertia mass, speed of the step or pallet chain, speed of the handrail, and/or wherein at least one of the parameter values of the motor model components and people conveyor model components of the power model are defined during testing of the people conveyor arrangement, by calculation, based on simulation and/or based on the model and type of the components of the system.

6. The method according to claim 1, further comprising the step of determining estimated motor power from the estimated load by using the power model.

7. The method according to claim 6, wherein the friction estimate is determined by using the passenger load estimate defined as essentially zero as a parameter value for the power model, and by adapting the friction estimate in the power model so that the difference between the measured power and estimated power based on power model is minimized.

8. The method according to claim 6, wherein the passenger load estimate is determined by using the friction estimate determined in the friction monitoring mode or an initial value of the friction estimate as a parameter value for the power model, and by adapting the passenger load estimate in the power module so that the difference between the measured power and estimated power based on power model is minimized.

9. The method according to claim 1, wherein the motor power is measured at a certain time instance or during a certain time frame, and/or means for determining the motor power are internal measuring means of an electrical converter or inverter unit or an external measuring apparatus.

10. The method according to claim 1, wherein at least one of the following is sent to a server, via a network: the determined friction value, the determined passenger load value, measured or determined motor power, the speed of the step or pallet chain, the speed of the handrail, the power model of the people conveyor arrangement, parameters and/or parameter values relating to the power model of the people conveyor arrangement.

11. A people conveyor arrangement, comprising:

at least a motor;

means for determining or measuring motor power;

a step or pallet chain;

a handrail;

means for determining a speed of the step or pallet chain and/or means for determining a speed of the handrail;

a power model, the power model comprising motor model components and/or people conveyor model components; and at least a friction monitoring mode, wherein, in the friction monitoring mode, the people conveyor arrangement is configured to determine a friction estimate of the people conveyor arrangement based at least in part on the measured or determined motor power, the power model of the people conveyor arrangement, and the speed of the step or pallet chain and/or the speed of the handrail.

12. The people conveyor arrangement according to claim 11, further comprising means to determine presence of passengers, and the people conveyor arrangement is configured to use the friction monitoring mode:

essentially always when no passengers are detected or at certain times when no passengers are detected; and when predefined conditions are fulfilled, the predefined conditions relating to a predetermined time window for determining friction estimate and/or the target number of friction estimate determinations in a predefined duration.

13. The people conveyor arrangement according to claim 11, further comprising a passenger load monitoring mode, wherein, in the passenger load monitoring mode, the people conveyor arrangement is configured to determine the passenger load estimate based at least in part on measured or determined motor power, the friction estimate, the power model of the people conveyor arrangement, and the speed of the step or pallet chain and/or the speed of the handrail, wherein the friction estimate is the friction estimate determined in the friction monitoring mode or based on an initial value if a friction estimate is not yet determined in the friction monitoring mode.

14. The people conveyor arrangement according to claim 13, further comprising means to determine presence of passengers, and the arrangement is configured to use the passenger load monitoring mode:

essentially always when passengers are determined to be present; or at certain times when passengers are determined to be present; and/or when predefined conditions are fulfilled, the predefined conditions relating to a deactivated state of the friction monitoring mode, a predetermined time window for determining passenger load estimate and/or the target number of passenger load estimate determinations in a predefined duration; and/or when the state of the people conveyor arrangement is changed from stopped or stand-by-speed to nominal speed.

15. The people conveyor arrangement according to claim 11, wherein the arrangement is configured to use as parameters of the power model of the people conveyor arrangement at least one of the following: motor losses, bearing losses, friction losses, inertia mass, speed of the step or pallet chain, speed of the handrail and/or wherein at least some of the parameter values of the motor model components and people conveyor model components of the power model are defined during testing of the people conveyor arrangement, by calculation, based on simulation and/or based on the model and type of the components of the system.

16. The arrangement according to claim 11, wherein the arrangement is configured to define estimated motor power from the estimated load by using the power model.

17. The arrangement according to claim 16, wherein the arrangement is configured to determine the friction estimate by using the passenger load estimate defined as essentially zero as a parameter value for the power model, and by adapting friction estimate in the power model so that the difference between the measured power and estimated power based on power model is minimized.

18. The arrangement according to claim 16, wherein the arrangement is configured to determine the passenger load estimate by using the friction estimate determined in the friction monitoring mode or an initial value of the friction estimate as a parameter value for the power model, and by adapting the passenger load estimate in the power module so that the difference between the measured power and estimated power based on power model is minimized.

19. The arrangement according to claim 11, wherein the arrangement is configured to measure the motor power at a certain time instance or during a certain time frame, average motor power during a predefined time frame, and/or wherein means for measuring motor power are internal measuring means of an electrical converter or inverter unit or an external measuring apparatus.

20. The arrangement according to claim 11, wherein the arrangement is configured to send to a server, via a network at least one of the following: the determined friction value, determined passenger load value, measured or determined motor power, speed of the step or pallet chain, speed of the handrail, the power model of the people conveyor, parameters and/or parameter values relating to the power model of the people conveyor.

21. A people conveyor system, comprising at least the arrangement according to claim 11.

* * * * *